US008627881B2

(12) United States Patent
Alahyari

(10) Patent No.: US 8,627,881 B2
(45) Date of Patent: Jan. 14, 2014

(54) HEAT EXCHANGER FIN INCLUDING LOUVERS

(75) Inventor: Abbas A. Alahyari, Manchester, CT (US)

(73) Assignee: Carrier Corporation, Farmington, CT (US)

( * ) Notice: Subject to any disclaimer, the term of this patent is extended or adjusted under 35 U.S.C. 154(b) by 412 days.

(21) Appl. No.: 13/001,646

(22) PCT Filed: Aug. 3, 2009

(86) PCT No.: PCT/US2009/052542

§ 371 (c)(1), (2), (4) Date: Dec. 28, 2010

(87) PCT Pub. No.: WO2010/019401

PCT Pub. Date: Feb. 18, 2010

(65) Prior Publication Data

US 2011/0108260 A1 May 12, 2011

Related U.S. Application Data

(60) Provisional application No. 61/089,084, filed on Aug. 15, 2008.

(51) Int. Cl.
*F28D 1/02* (2006.01)
*F28F 1/30* (2006.01)

(52) U.S. Cl.
USPC ..... 165/152; 165/182

(58) Field of Classification Search
CPC ..... F28F 3/027
USPC ..... 165/152, 179, 182; 62/515
See application file for complete search history.

(56) References Cited

U.S. PATENT DOCUMENTS

| | | | |
|---|---|---|---|
| 3,902,551 | A | 9/1975 | Lim et al. |
| 4,614,230 | A | 9/1986 | Sakuma et al. |
| 4,676,304 | A | 6/1987 | Koisuka et al. |
| 4,999,037 | A | 3/1991 | Albritton et al. |
| 5,111,876 | A | 5/1992 | Nash |
| 5,752,567 | A | 5/1998 | Obosu |
| 5,890,532 | A | 4/1999 | Kim et al. |
| 5,927,392 | A | 7/1999 | Youn et al. |

(Continued)

FOREIGN PATENT DOCUMENTS

| | | |
|---|---|---|
| DE | 19641029 A1 | 4/1998 |
| JP | 61140790 | 6/1986 |

(Continued)

OTHER PUBLICATIONS

International Preliminary Report on Patentability mailed on Feb. 24, 2011 for PCT Application No. PCT/US2009/052542.

(Continued)

*Primary Examiner* — Tho V Duong
(74) *Attorney, Agent, or Firm* — Carlson, Gaskey & Olds, PC

(57) ABSTRACT

A heat exchanger includes a first header, a second header and heat exchange tubes that extend between the first header and the second header. A fin is located between two adjacent heat exchange tubes, and the fin includes fin plates each having louvers. Each of the louvers includes a first louver section, a second louver section and a third louver section between the first louver section and the second louver section. The third louver section includes a drain portion that extends downwardly relative to the first louver section and the second louver section.

11 Claims, 4 Drawing Sheets

(56) References Cited

U.S. PATENT DOCUMENTS

| | | | | |
|---|---|---|---|---|
| 5,975,199 | A | 11/1999 | Park et al. | |
| 6,125,925 | A | 10/2000 | Obosu et al. | |
| 6,308,527 | B1 | 10/2001 | Kuroyanagi et al. | |
| 6,340,055 | B1 * | 1/2002 | Yamauchi et al. | 165/174 |
| 6,401,809 | B1 | 6/2002 | Zhang et al. | |
| 6,932,153 | B2 * | 8/2005 | Ko et al. | 165/110 |
| 2002/0079092 | A1 | 6/2002 | Shembekar et al. | |
| 2006/0157233 | A1 * | 7/2006 | Ozaki et al. | 165/152 |
| 2007/0137840 | A1 | 6/2007 | Ninagawa et al. | |
| 2007/0199686 | A1 | 8/2007 | Okinotani et al. | |
| 2007/0204977 | A1 * | 9/2007 | Beamer et al. | 165/124 |

FOREIGN PATENT DOCUMENTS

| | | | | |
|---|---|---|---|---|
| JP | 61140790 | A | | 6/1986 |
| JP | 62-18582 | | | 2/1987 |
| JP | 1305296 | A | | 12/1989 |
| JP | 01305296 | A | * | 12/1989 |
| JP | 56157793 | | | 12/1989 |
| JP | 02309193 | A | * | 12/1990 |
| JP | 2000179988 | | | 6/2000 |
| JP | 2004101074 | A | * | 4/2004 |
| JP | 2004177039 | | | 6/2004 |
| JP | 2007232246 | A | | 9/2007 |

OTHER PUBLICATIONS

Extended European Search Report for EP Application No. 09807066.7 dated Jan. 3, 2013.

Search Report and Written Opinion mailed on Mar. 16, 2010 for PCT/US2009/052542.

* cited by examiner

HEAT EXCHANGER FIN INCLUDING LOUVERS

RELATED APPLICATIONS

This application claims priority to U.S. Provisional Patent Application No. 61/089,084, which was filed Aug. 15, 2008.

BACKGROUND OF THE INVENTION

A microchannel heat exchanger (MCHX) includes heat exchange tubes with a flattened surface that extend between two headers. Refrigerant flows through the heat exchange tubes and exchanges heat with air that flows over the heat exchange tubes. A folded fin including a plurality of fin plates can be located between two adjacent heat exchange tubes. Each fin plate is connected to an adjacent fin plate with a curved portion. Each fin plate includes louvers to create turbulence in the airflow and enhance heat transfer between the refrigerant and the air. The louvers have a length extending between the heat exchange tubes.

Due to the higher surface density, condensation and frost can form in the microchannel heat exchanger. Any condensate that forms can flow along the surface of the fin in a serpentine path towards the bottom of the fin. However, the condensate can build up in the curved portions near the heat exchange tubes where it is coldest and form frost.

FIG. 1 illustrates a prior art fin plate 100 including a plurality of louvers 102 each separated by a gap 104. An entirety of each louver 102 is located in a single plane.

In one prior heat exchanger described in U.S. Pat. No. 4,676,304, some of the louvers of a fin plate are angled downwardly with respect to a body of the fin plate, and other louvers of the fin plate are recessed and located below and parallel to the body of the fin plate. The angled louvers are located in one portion of the fin plate, and the recessed louvers are located in another portion of the fin plate.

In another prior heat exchanger described in Japanese Publication No. JP56157793, a crest portion is located in a middle of the length of each louver, the crest portion being higher than ends of the louver. Any condensate that forms on the fins is directed towards the lower ends of the louver and near the heat exchange tubes for draining.

SUMMARY OF THE INVENTION

A heat exchanger includes a first header, a second header and heat exchange tubes that extend between the first header and the second header. A fin is located between two adjacent heat exchange tubes, and the fin includes fin plates each having louvers. Each of the louvers includes a first louver section, a second louver section and a third louver section between the first louver section and the second louver section. The third louver section includes a drain portion that extends downwardly relative to the first louver section and the second louver section.

In another illustrative embodiment, a fin of a heat exchanger includes fin plates and louvers. Each of the louvers includes a first louver section, a second louver section and a third louver section between the first louver section and the second louver section. The third louver section includes a drain portion that extends downwardly relative to the first louver section and the second louver section.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
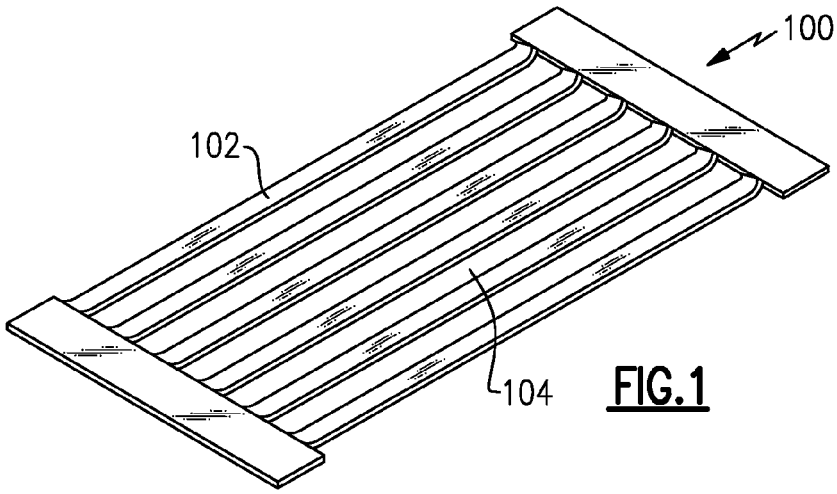
FIG. 1 illustrates a prior art fin plate.
Figure 2:
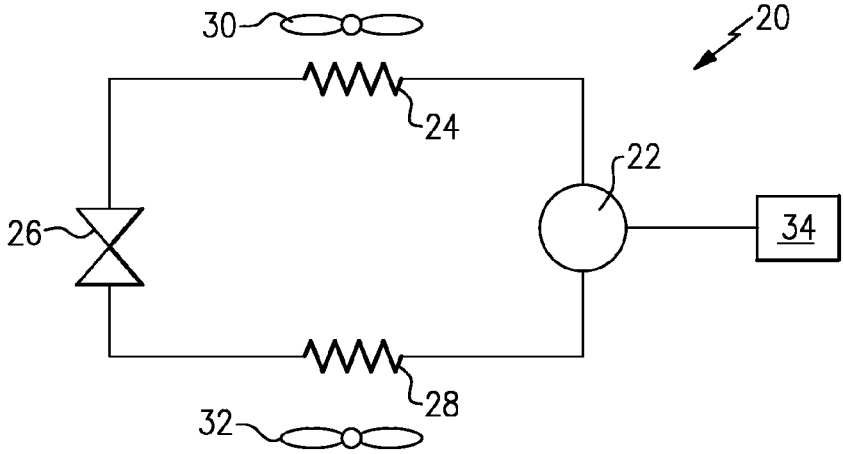
FIG. 2 illustrates a prior art refrigeration system.

FIG. 2 illustrates a refrigeration system 20 including a compressor 22, a first heat exchanger 24, an expansion device 26, and a second heat exchanger 28. Refrigerant circulates through the closed circuit refrigeration system 20.

When the refrigeration system 20 is operating in a cooling mode, the refrigerant exits the compressor 22 at a high pressure and a high enthalpy and flows through the first heat exchanger 24, which acts as a condenser. In the first heat exchanger 24, the refrigerant rejects heat to air and is condensed into a liquid that exits the first heat exchanger 24 at a low enthalpy and a high pressure. A fan 30 directs the air through the first heat exchanger 24. The cooled refrigerant then passes through the expansion device 26, expanding the refrigerant to a low pressure. After expansion, the refrigerant flows through the second heat exchanger 28, which acts as an evaporator or a cold heat exchanger. In the second heat exchanger 28, the refrigerant accepts heat from air, exiting the second heat exchanger 28 at a high enthalpy and a low pressure. A fan 32 blows air through the second heat exchanger 28. The refrigerant then flows to the compressor 22, completing the cycle.

The refrigeration system 20 can include a four-way valve 34 that reverses the direction of refrigerant flow. When the refrigeration system 20 is operating in the cooling mode, the four-way valve 34 directs the refrigerant from the compressor 22 to the first heat exchanger 24, and the second heat exchanger 28 acts as an evaporator or a cold heat exchanger. When the refrigeration system 20 is operating in a heating mode, the four-way valve 34 directs the refrigerant from the compressor 22 to the second heat exchanger 28, and the first heat exchanger 24 operates as an evaporator or a cold heat exchanger.

Either or both of the heat exchangers 24 and 28 can be a microchannel heat exchanger 36. The microchannel heat exchanger 36 can be part of a refrigeration system 20 used with a microdevice or an automobile air conditioner. For example, the microchannel heat exchanger 36 can be employed for an automotive, residential or aerospace HVAC application due to the compactness, lower cost and performance of the microchannel heat exchanger 36. For ease of reference, the microchannel heat exchanger can be referred to as a microchannel heat exchanger 36.

Figure 3:
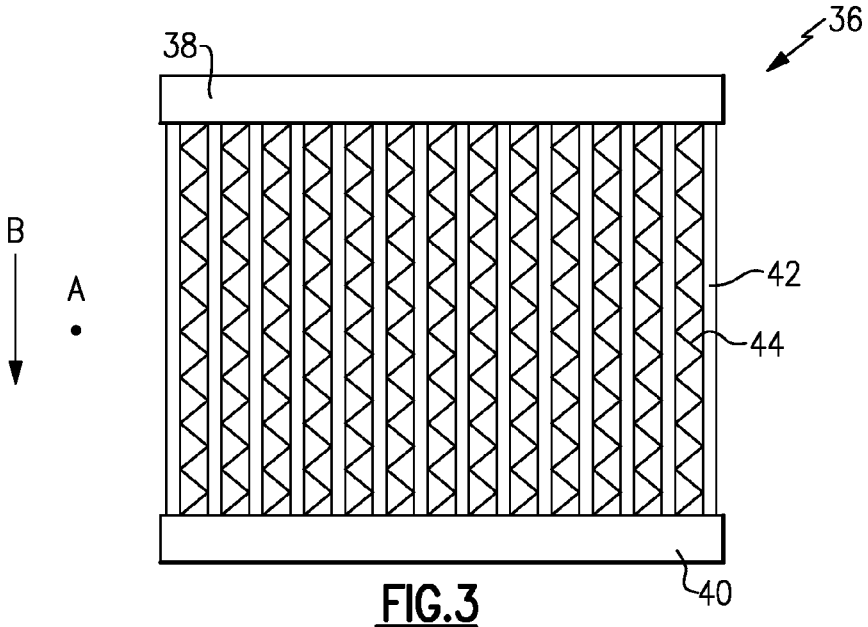
FIG. 3 illustrates a microchannel heat exchanger.

FIG. 3 illustrates the microchannel heat exchanger 36. The microchannel heat exchanger 36 includes a first header 38, a second header 40, and a plurality of flat heat exchange tubes 42 that extend between the headers 38 and 40. The heat exchange tubes 42 are substantially parallel and extend in a vertical direction. In one example, each heat exchange tube 42 is a flat multi-port tube, and each port has a hydraulic diameter of less than 5 mm. A fin 44 is located between adjacent heat exchange tubes 42 to increase heat transfer.

The refrigerant enters the microchannel heat exchanger 36 through the first header 38 and flows downwardly in a direction B through the heat exchange tubes 42. The air flows into the page in a direction A. As the refrigerant flows through the heat exchange tubes 42 towards the second header 40, the refrigerant exchanges heat with the air that flows over the heat exchange tubes 42. If the microchannel heat exchanger 36 is an evaporator or a cold heat exchanger, the air is cooled as it flows over the heat exchange tubes 42. If a single phase liquid (such as glycol or water) is used as the refrigerant, the microchannel heat exchanger 36 is a cold heat exchanger. If a two phase refrigerant (a refrigerant that enters the microchannel heat exchanger 36 as a liquid and exits the microchannel heat exchanger 36 as a vapor) is employed, the microchannel heat exchanger 36 is an evaporator.

Figure 4:
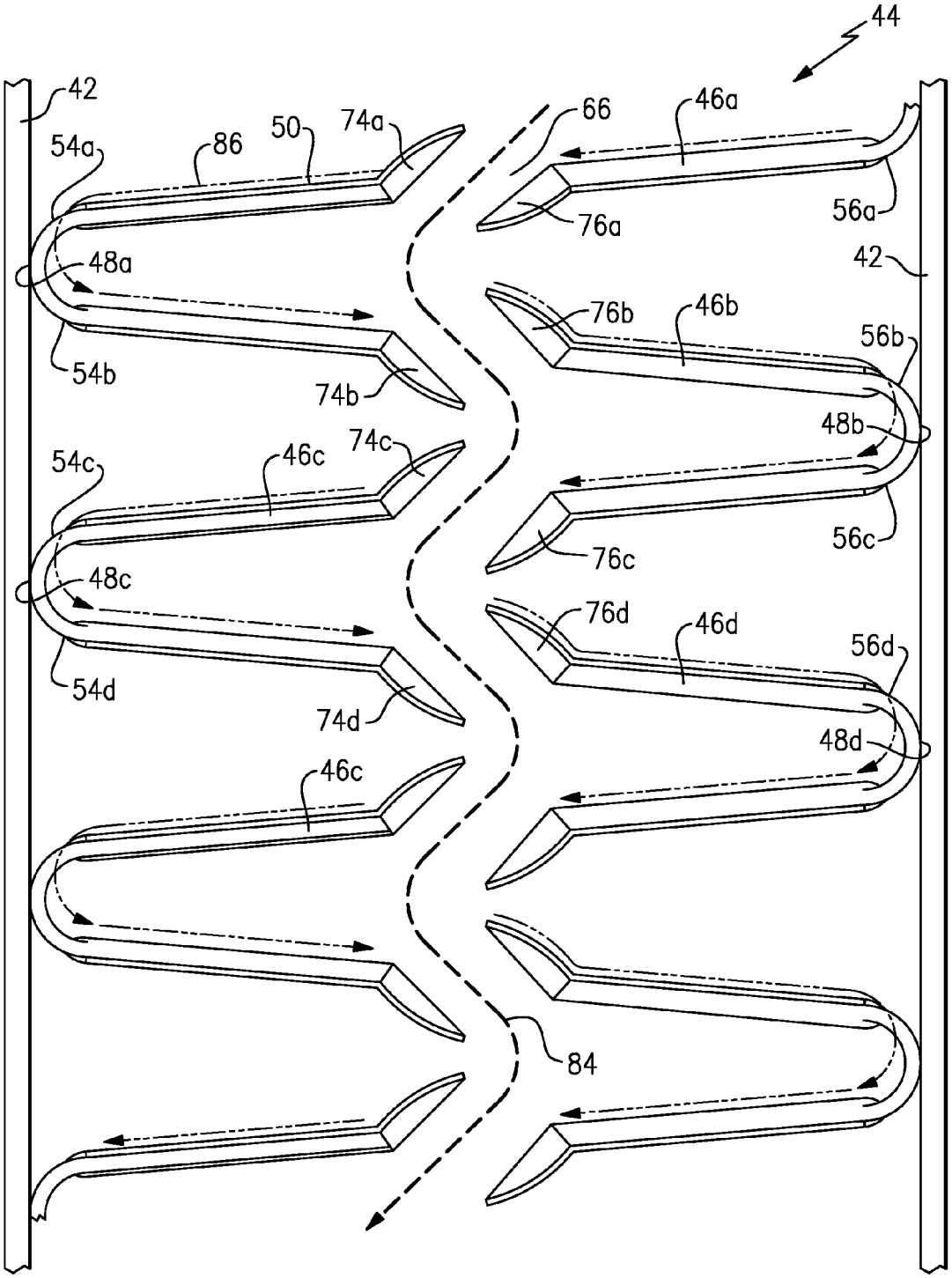
FIG. 4 illustrates flow paths of condensate along a fin.

FIG. 4 illustrates one of the fins 44 of the microchannel heat exchanger 36. The fins 44 have a serpentine shape and are made of metal. In one example, the fins 44 are made of aluminum sheet that is stamped and bent into the serpentine shape.

Each fin 44 includes a plurality of fin plates 46 are each slightly angled with respect to the horizontal. That is, each fin plate 46 is non-parallel with the horizontal. Each fin plate 46 is also non-parallel with an adjacent fin plate 46. For example, a first fin plate 46*a*, the third fin plate 46*c*, and any further alternate fin plates 46 are substantially parallel, and the second fin plate 46*b*, the fourth fin plate 46*d* and any further alternate fin plates 46 are substantially parallel. The first fin plate 46*a* and the third fin plate 46*b* are non-parallel to the second fin plate 46*b* and the fourth fin plate 46*d*. The pattern is repeated with the plurality of fin plates 46 to form the serpentine shape fin 44. That is, each fin plate 46 has a configuration that is opposite to (or a minor image of) an adjacent fin plate 46. Therefore, the fin plates 46*a*, 46*c* and any alternate fin plates have a first orientation, and the fin plates 46*b*, 46*d* and any alternate fin plates have a second orientation.

Figure 5:
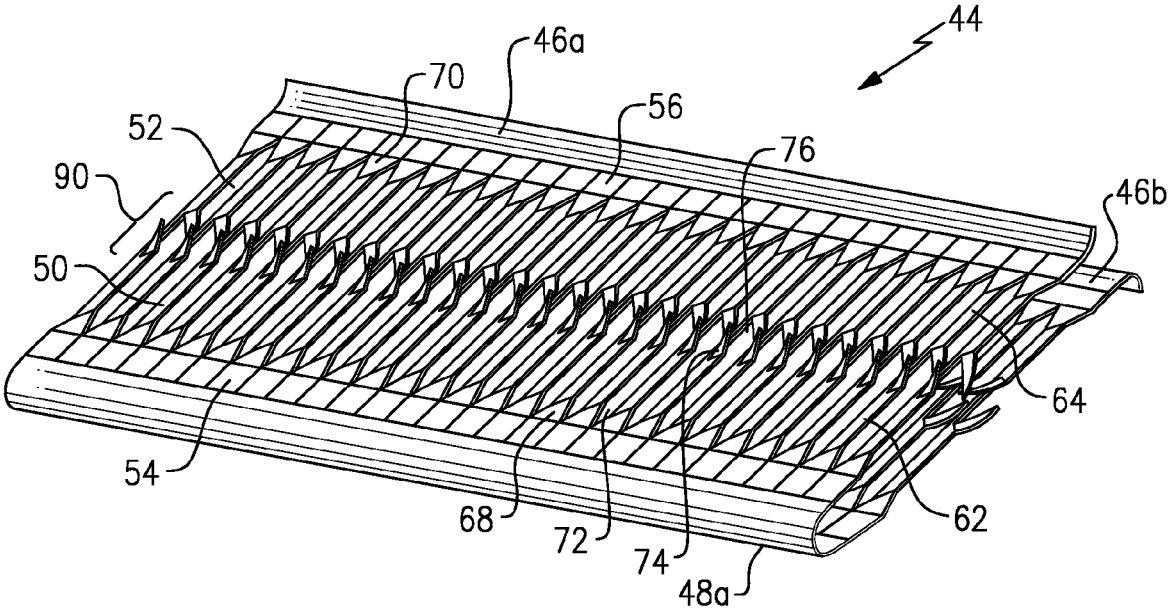
FIG. 5 illustrates a perspective view of a portion of the fin of the microchannel heat exchanger.

A curved portion 48 connects adjacent fin plates 46. A heat exchange tube 42 is located on both sides of each fin 44 and next to the curved portions 48. A perspective view of a portion of a fin 44 including two fin plates 46*a* and 46*b* connected by the curved portion 48*a* is shown in FIG. 5.

Figure 6:
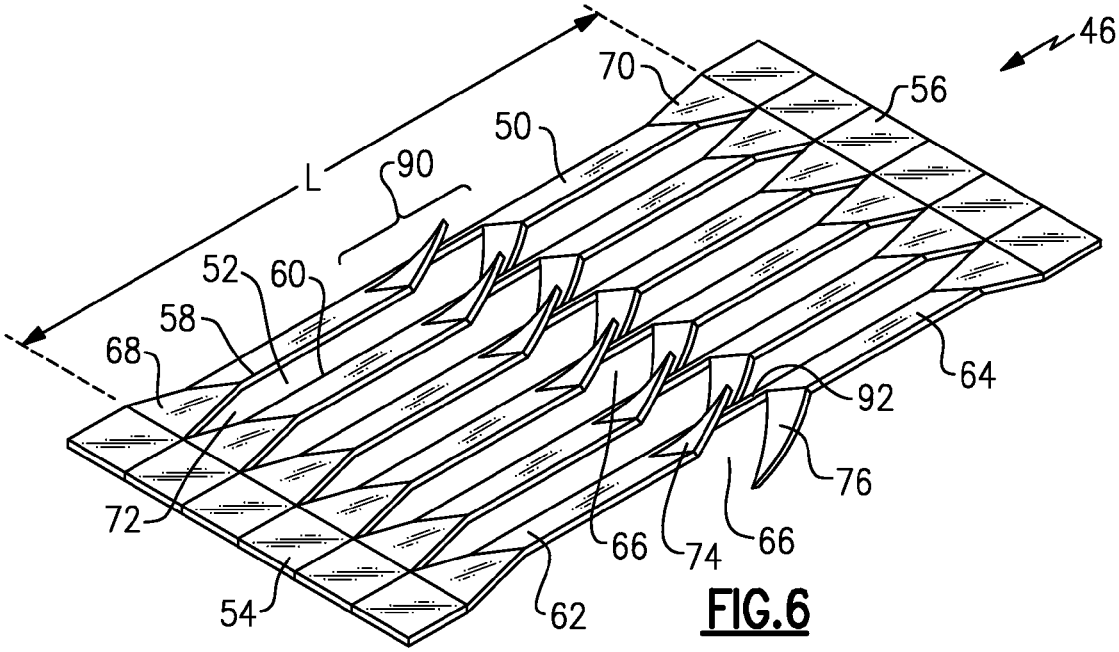
FIG. 6 illustrates a fin plate of the fin.

FIG. 6 illustrates a first example fin plate 46. The fin plate 46 includes a plurality of louvers 50 each separated by a slot 52. Each fin plate 46 includes a first end plate 54, a second end plate 56, and the plurality of louvers 50 having a length L that extend between the end plates 54 and 56.

Each fin plate 46 defines a plane, and the louvers 50 extend at an angle relative to the plane. Each louver 50 includes a first edge 58 and a second edge 60 that are substantially parallel to the length L of the louver 50. One of the slots 52 is defined between the first edge 58 of one louver 50 and the second edge 60 of an adjacent louver 50. The first edge 58 of one louver 50 is higher relative to the second edge 60 of the adjacent louver 50 due to the angling or inclination of the louvers 50. When air flows through the fin 44, the angled louvers 50 redirect the air and provide turbulence to increase heat transfer between the air and the refrigerant.

Each louver 50 includes a first louver section 62, a second louver section 64, and a third louver section 90 located between the louver sections 62 and 64. The first louver section 62 and the second louver section 64 are located in a common plane. An outer end of the first louver section 62 is connected to the end plate 54 by a first connecting portion 68, and an outer end of the second louver section 64 is connected to the end plate 56 by a second connecting portion 70. In one example, the connecting portions 68 and 70 are substantially triangular. The louver sections 62 and 64 are angled with respect to the connecting portions 68 and 70. That is, the plane defined by the louver sections 62 and 64 is different than the plane defined by the connecting portions 68 and 70. If the connecting portions 68 and 70 are triangular, the slots 52 include a pointed end 72 that is defined by the connecting portions 68 and 70.

The third louver section 90 includes a first drain portion 74, a second drain portion 76, a connecting portion 92 and a gap 66. The first drain portion 74 is attached to an inner end of the first louver section 62, and the second drain portion 76 is attached to an inner end of the second louver section 64. In one example, the drain portions 74 and 76 are triangular in shape. In one example, one of the drain portions 74 and 76 is bent away from the louver 50 to extend upwardly relative to the plane defined by the louver sections 62 and 64, and the other of the drain portions 74 and 76 is bent away from the louver 50 to extend downwardly relative to the plane defined by the louver sections 62 and 64. In one example, the drain portions 74 and 76 are substantially parallel. In one example, both the drain portions 74 and 76 are bent away from the louver 50 to extend downwardly relative to the plane defined by the louver sections 62 and 64. Therefore, at least one of the drain portions 74 and 76 is located below (or lower relative to) the outer ends of the louver sections 62 and 64.

The gap 66 is defined between the drain portions 74 and 76. In one example, the gap 66 is located in the center or the middle of the length L of the louver 50.

When the drain portions 74 and 76 are stamped and bent away from the louver 50, the remaining material of the louver 50 forms the connecting portion 92 that connects the louver sections 62 and 64. The connecting portion 92 connects and is co-planar with the first louver section 62 and the second louver section 64. The connecting portion 92 can have any width. In one example, the connecting portion 92 is half the width of the louver sections 62 and 64. In another example, the connecting portion 92 is one fourth the width of the louver sections 62 and 64. Alternately, the connecting portion 92 can have any intermediate width. As the connecting portion 92 is formed from the metal that remains after the drain portions 74 and 76 are bent, the width of the connecting portion 92 relates to the size of the drain portions 74 and 76. That is, if the drain portions 74 are 76 are larger, the width of the connecting portion 92 is reduced. However, if the drain portions 74 and 76 are smaller, the width of the connecting portion 92 is increased.

Returning to FIG. 4, in one example, the drain portion 74*a* of the fin plate 46*a* extends upwardly, and the drain portion 76*b* of the fin plate 46*a* extends downwardly. The drain portion 74*b* of the fin plate 46*b* extends downwardly, and the drain portion 76*b* of the fin plate 46*b* extends upwardly. The drain portion 74*c* of the fin plate 46*c* extends upwardly, and the drain portion 76*c* of the fin plate 46*c* extends downwardly. The drain portion 74*d* of the fin plate 46*d* extends downwardly, and the drain portion 76*d* of the fin plate 46*d* extends upwardly. This pattern repeats for alternating fin plates 46 of the fin 44.

If the drain portions 74 and 76 extend in opposite directions relative to the plane defined by the louver sections 62 and 64 (one upwardly and the other downwardly, respectively), the fin 44 can be installed reversibly in the microchannel heat exchanger 36. That is, the fin 44 can be installed upside down relative to the example shown in FIG. 4.

When the microchannel heat exchanger 36 is operating as an evaporator or a cold heat exchanger, condensate can form on the surface of the microchannel heat exchanger 36. If the condensate remains on the surface of the microchannel heat exchanger 36 and is not removed, frost can form.

The flow path of the condensate through the fin 44 to the bottom of the fin 44 is shown. The condensate can flow to the bottom of the fin 44 through a first flow path 84 and/or a serpentine shaped second flow path 86. As the condensate flows to the bottom of the fin 44, the condensate can flow through either or both of the flow paths 84 and 86.

The condensate in the first flow path 84 (shown in dashed lines) is directed from the fin plate 46*a* by the drain portion 76*a* to the below fin plate 46*b* through the gap 66. Some of the condensate can then be directed to the below fin plate 46*c* by the drain portion 74*b* through the gap 66. The condensate can continue to flow along this flow path 84 to the bottom of the fin 44.

Although most of the condensate flows along the first flow path 84, some condensate can also flow along the second flow path 86 (shown in broken lines) to the bottom of the fin 44. The condensate flows over the fin plate 46*a*, over the curved portion 48*a* and onto the fin plate 46*b*. Some of the condensate can then flow over the fin plate 46*b*, over the curved portion 48*b* and onto the fin plate 46*c*. This flow pattern is repeated along the surface of the fin 44 until the condensate reaches the bottom of the fin 44.

The first flow path 84 enhances drainage of the condensate from the microchannel heat exchanger 36 and provides a shorter and more direct flow path of the condensate to the bottom of the fin 44 through the middle or center of the fin plate 46. The center of the fin plate 46 is warmer than the colder edges of the fin plate 46 located near the heat exchange tubes 42, decreasing the formation of frost. The condensate has minimal contact with the folds defined by the curved portions 48, where frost is most likely to form. This improves drainage of the condensate in the microchannel heat exchanger 36, decreases condensate retention, decreases frost accumulation on the microchannel heat exchanger 36, and improves performance under wet or frosting conditions.

Figure 7:
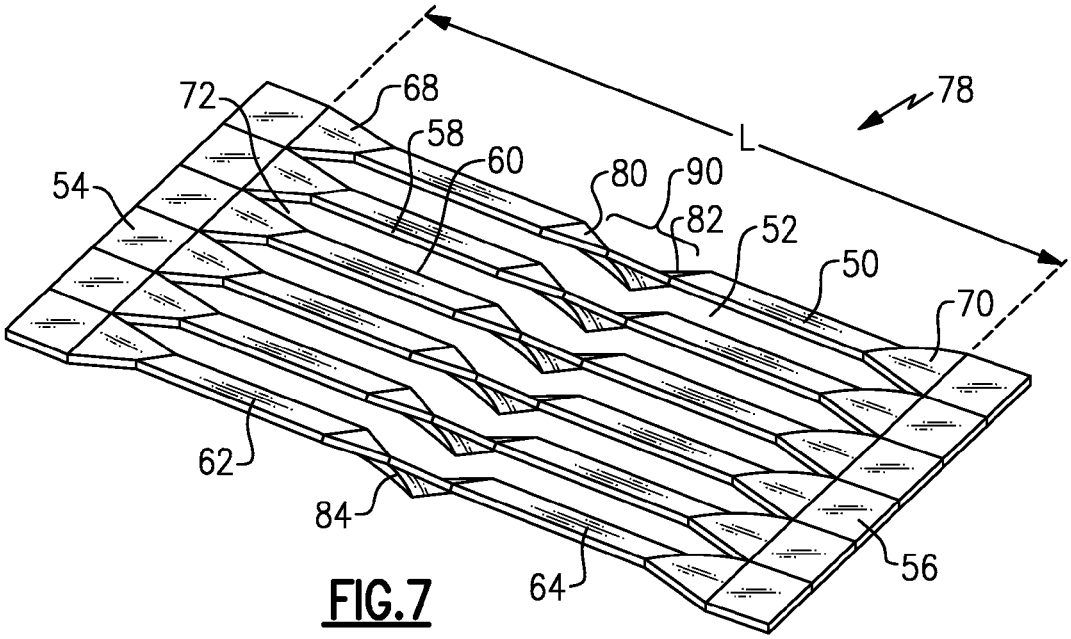
FIG. 7 illustrates another example fin plate of the fin.

FIG. 7 illustrates another example fin plate 78. The fin plate 78 includes the features of the fin plate 46, but includes two downwardly extending drain portions 80 and 82 that connect at an intersection line 88. That is, the downwardly extending drain portions 80 and 82 form a single component with no gap therebetween. The intersection line 88 is non-parallel with a horizontal. The downwardly extending drain portions 80 and 82 are located between the louver sections 62 and 64 and define the third louver section 90 of the louver 50. In one example, the downwardly extending drain portion 80 is attached to the louver section 62, and the downwardly extending drain portion 82 is attached to the louver section 62. In one example, the louver sections 62 and 64 are identical in shape, but minor images of each other. The intersection line 88 extends in a generally downwardly direction and is located in the center or the middle of the length L of the louver 50.

When condensate forms on the fin 44, the downwardly extending drain portions 80 and 82 and the intersection line 88 direct the condensate to the below fin plate 46 along the first flow path 84. The condensate continues to flow in this pattern to the bottom of the fin 44. Some condensate can also flow over the surface of the fin plates 78 in the serpentine pattern along the second flow path 86.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A heat exchanger comprising:

a first header;

a second header;

a plurality of heat exchange tubes extending between the first header and the second header;

a fin located between two adjacent heat exchange tubes, wherein the fin includes a plurality of fin plates each having a plurality of louvers, and each of the plurality of louvers includes a first louver section, a second louver section and a third louver section between the first louver section and the second louver section, wherein the third louver section includes a first drain portion that extends in a first direction away from the first louver section and the second louver section; and there being a second drain portion also extending away from said first louver section and the second louver section, and said first and second drain portions being connected by a connecting portion which is not bent away from said first louver section and the second louver section, such that said connecting portion connecting said first and second louver sections.

2. The heat exchanger as recited in claim 1 wherein each of the plurality of fin plates is non-parallel to an adjacent fin plate.

3. The heat exchanger as recited in claim 1 wherein the first louver section and the second louver section are located in a common plane.

4. The heat exchanger as recited in claim 1 wherein the third louver section includes the second drain portion that extends in a second direction away from the first louver section and the second louver section, and a gap is defined between the first drain portion and the second drain portion.

5. The heat exchanger as recited in claim 4 wherein the first drain portion and the second drain portion are substantially parallel.

6. The heat exchanger as recited in claim 4 wherein each of the plurality of louvers has a length, and the gap is located substantially at a center of the length.

7. The heat exchanger as recited in claim 1 wherein the third louver section includes a first drain portion that extends in the first direction away from the first louver section and the second louver section, and the first drain portion and the second drain portion are connected at an intersection line.

8. The heat exchanger as recited in claim 7 wherein each of the plurality of louvers has a length, and the intersection line is located substantially at a center of the length.

9. The heat exchanger as recited in claim 7 wherein the intersection line is non-parallel with a horizontal.

10. The heat exchanger as recited in claim 1 wherein the first louver section and the second louver section each include an outer end, and the drain portion is located below the outer ends of the louver sections.

11. The heat exchanger as recited in claim 1, wherein the connecting portion is formed when the drain portions are bent away from a louver, and remaining material of the louver forming the connecting portion, such that the connecting portion connects and is co-planer with the first and second louver sections.

* * * * *